US010151040B2

(12) United States Patent
Fournier et al.

(10) Patent No.: US 10,151,040 B2
(45) Date of Patent: Dec. 11, 2018

(54) HYDROGEN GAS DIFFUSION ANODE ARRANGEMENT PRODUCING HCL

(71) Applicant: ALLIANCE MAGNÉSIUM, Brossard (CA)

(72) Inventors: Joël Fournier, Brossard (CA); Lionel Roué, Sainte-Julie (CA); Sébastien Helle, Montreal (CA)

(73) Assignee: ALLIANCE MAGNÉSIUM, Brossard, QC (CA)

( * ) Notice: Subject to any disclaimer, the term of this patent is extended or adjusted under 35 U.S.C. 154(b) by 269 days.

(21) Appl. No.: 14/438,979

(22) PCT Filed: Feb. 14, 2014

(86) PCT No.: PCT/CA2014/050102

§ 371 (c)(1),
(2) Date: Apr. 28, 2015

(87) PCT Pub. No.: WO2014/124539

PCT Pub. Date: Aug. 21, 2014

(65) Prior Publication Data

US 2015/0345038 A1 Dec. 3, 2015

Related U.S. Application Data

(60) Provisional application No. 61/764,711, filed on Feb. 14, 2013.

(51) Int. Cl.
*C25C 7/02* (2006.01)
*C25C 1/02* (2006.01)
(Continued)

(52) U.S. Cl.
CPC ..... *C25C 7/02* (2013.01); *C25B 1/26* (2013.01); *C25C 1/02* (2013.01); *C25C 3/04* (2013.01);
(Continued)

(58) Field of Classification Search
CPC .... C25B 1/26; C25C 1/02; C25C 3/04; C25C 3/06; C25C 7/02; C25C 7/025; C25C 7/06
See application file for complete search history.

(56) References Cited

U.S. PATENT DOCUMENTS 5,114,547 A * 5/1992 Ullman ..... C25C 7/02 204/252
5,753,099 A * 5/1998 Gravel ..... C25C 7/00 204/271
(Continued)

FOREIGN PATENT DOCUMENTS

| | | |
|---|---|---|
| CA | 2265183 | 9/2000 |
| CN | 102168288 A | 8/2011 |
| DE | 261587 | 11/1988 |

*Primary Examiner* — Ciel P Thomas
(74) *Attorney, Agent, or Firm* — Norton Rose Fulbright LLP

(57) ABSTRACT

The present description relates to an anode arrangement for use in an electrolysis production of metals comprising an anode having a hollow body comprising a cavity, the body having at least one gas outlet connected in flow communication with the cavity. A gas inlet is connected in fluid flow communication with the cavity of the anode, the gas inlet being connectable to a source of hydrogen gas for feeding hydrogen gas into the cavity of the anode. The anode arrangement also comprises an electrical connector and a hydrogen chloride (HCl) recuperator surrounding at least a portion of the anode for recovering HCl gas released through the at least one gas outlet at an outer surface of the anode during electrolysis.

18 Claims, 10 Drawing Sheets

(51) Int. Cl.

| | |
|---|---|
| ***C25C 3/04*** | (2006.01) |
| ***C25C 3/06*** | (2006.01) |
| ***C25C 7/06*** | (2006.01) |
| ***C25B 1/26*** | (2006.01) |

(52) U.S. Cl.
CPC ..... *C25C 3/06* (2013.01); *C25C 7/025* (2013.01); *C25C 7/06* (2013.01)

(56) References Cited

U.S. PATENT DOCUMENTS

| | | | | |
|---|---|---|---|---|
| 6,805,777 | B1 | 10/2004 | D'Astolfo, Jr. | |
| 2001/0017260 | A1 | 8/2001 | Zabelin et al. | |
| 2002/0014416 | A1* | 2/2002 | Van Weert | C25C 3/04 205/404 |
| 2002/0134507 | A1* | 9/2002 | DeDontney | C23C 16/45576 156/345.33 |
| 2005/0092619 | A1* | 5/2005 | Hryn | C25C 3/18 205/394 |
| 2006/0000774 | A1* | 1/2006 | Johnson | B01D 61/18 210/636 |
| 2007/0261954 | A1* | 11/2007 | Bakhir | C02F 1/4674 204/260 |
| 2011/0083968 | A1* | 4/2011 | Gilliam | B01D 53/326 205/555 |
| 2015/0218720 | A1* | 8/2015 | Picard | C25C 1/08 205/405 |

* cited by examiner

HYDROGEN GAS DIFFUSION ANODE ARRANGEMENT PRODUCING HCL

CROSS-REFERENCE TO RELATED APPLICATIONS

This application is a National entry of PCT/CA2014/050102 filed Feb. 14, 2014, in which the United States of America was designated and elected, and which remains pending in the International phase until Aug. 14, 2015, which application in turn claims priority under 35 USC 119(e) from U.S. Provisional Application Ser. No. 61/764,711, filed Feb. 14, 2013.

TECHNICAL FIELD

The present description relates to an hydrogen gas diffusion anode arrangement for use in electrolytic production of metals such as magnesium and aluminum producing hydrogen chloride (HCl) as a by-product.

BACKGROUND ART

Aluminum and magnesium are common structural metal with high commercial interest.

Pure aluminum (Al) is a silver-white, malleable, ductile metal with one-third the density of steel. It is the most abundant metal in the earth's crust. Aluminum is an excellent conductor of electricity and has twice the electrical conductance of copper. It is also an efficient conductor of heat and a good reflector of light and radiant heat.

Unlike most of the other major metals, aluminum does not occur in its native state, but occurs ubiquitously in the environment as silicates, oxides and hydroxides, in combination with other elements such as sodium and fluoride, and as complexes with organic matter. When combined with water and other trace elements, it produces the main ore of aluminum known as bauxite.

Magnesium compounds, primarily magnesium oxide (MgO), are used as a refractory material in furnace linings for producing iron, steel, nonferrous metals, glass and cement. Magnesium oxide and other magnesium compounds are also used in the agricultural, chemical, automobile, aerospace and construction industries.

Presently, aluminum is produced by separating pure alumina from bauxite in a refinery, then treating the alumina by electrolysis using the Hall-Heroult and Bayer processes. An electric current flowing through a molten electrolyte, in which alumina has been dissolved, separates the aluminum oxide into oxygen, which collects on carbon anodes immersed in the electrolyte, and aluminum metal, which collects on the bottom of the carbon-lined cell (cathode). On average, it takes about 4 t of bauxite to obtain 2 t of aluminum oxide, which in turn yields 1 t of metal. For over 120 years, the Bayer process and the Hall-Heroult process together have been the standard commercial method of the production of aluminum metal. These processes require large amounts of electricity and generate undesired by products, such as fluorides in the case of the Hall-Heroult process and red mud in the case of the Bayer process.

The production of aluminum by electrolysis of aluminum chloride has been a long-desired and theoretically feasible objective; the economic attainment thereof has never become an economic reality. Among the many reasons therefor are numerous unsolved problems occasioned, for example, the highly corrosive chlorine vapors or gases emanating from the electrolysis, as well as the complex salts or eutectics of the bath components and the products of electrolysis, all of which will be herein broadly encompassed by the term electrolyte, are of corrosive character and apparently compound the problem. Among such problems are the short life of cell components and the detrimental contamination of the bath through reaction thereof with the confining environmental elements in the electrolytic cells.

Taking out the magnesium metal from unrefined materials is a force exhaustive procedure requiring nicely tuned technologies. Presently, to extract magnesium, an electrolysis process is generally used. The tailings are leached in hydrochloric acid, creating a brine from which the magnesium is extracted using electrolysis. Thermal lessening of magnesium oxide is also used for extracting magnesium from ores.

Conventionally, during the course of electrolytic production of magnesium, chlorine gas is formed at the anode (metallic magnesium being formed at the cathode). Conventional anodes used in such process are made of graphite. At the high temperatures involved, the chlorine gas tends to attack the graphite anode and various chlorinated carbon compounds may be formed. The chlorine gas itself and the chlorinated carbon compounds are environmentally hazardous and are difficult to remove and are expensive to deal with. In addition, because the graphite anode is slowly consumed by this reaction, the anode itself must be periodically replaced, at not an insignificant expense.

There is thus still a need to be provided with improved processes for extracting metals such as aluminum and magnesium.

SUMMARY

In accordance with the present description, there is now provided an anode arrangement for use in an electrolysis production of metals comprising an anode having a hollow body comprising a cavity extending longitudinally from a first end portion to a second end portion of the anode, said body having at least one gas outlet connected in fluid flow communication with the cavity; a gas inlet connected in fluid flow communication with the cavity of said anode, said gas inlet being connectable to a source of hydrogen gas for feeding hydrogen gas into the cavity of said anode; an electrical connector for generating a current at the anode during electrolysis; and a hydrogen chloride (HCl) recuperator surrounding at least a portion of the anode for recovering HCl gas released through the at least one gas outlet at an outer surface of the anode during electrolysis, the HCl recuperator having an outlet connectable to a HCl redistributor.

In an embodiment, the first end portion is a top portion of the anode and the second end portion is a bottom portion of the anode, the gas inlet connected to the top portion or bottom portion of the anode.

In another embodiment, the electrical connector extends into the cavity of the anode.

In a further embodiment, the electrical connector extends into the gas inlet into the cavity of the anode.

In an embodiment, the metals are magnesium or aluminum.

In an alternative embodiment, the anode is a cylindrical anode.

In a further embodiment, the anode comprises a plurality of gas outlets symmetrically spaced on the body of the anode.

In another embodiment, the size of the gas outlets increases from the top portion of the anode to the bottom portion of the anode.

In a further embodiment, the gas outlets are spaced in rows and columns on the body of the anode.

In another embodiment, each gas outlets within each row are of the same size.

In a supplemental embodiment, the gas outlets are cylindrical bores.

In another embodiment, the gas outlets are elongated taper channels from the bottom portion to the top portion of the anode.

In a further embodiment, the anode is a metal diffuser.

In another embodiment, the anode is made of sintered metal powders.

In an additional embodiment, the anode is made of graphite or Hastalloy X.

In an embodiment, the gas inlet is the HCl recuperator, extending partially and surrounding at least a portion of the anode recovering HCl gas released through the gas outlet at the outer surface of the anode during electrolysis.

In a further embodiment, the HCl recuperator is a sintered alumina tube.

In an embodiment, the at least one gas outlet as an opening of at least 5 μm.

In another embodiment, the anode described herein further comprises an electrocatalyst.

It is also provided in an embodiment an electrolytic cell for electrolyzing metals chloride comprising, the anode arrangement as described herein; a cathode being separated from the anode, the HCl gas released through the gas outlet at the outer surface of the anode is separated from the metals produced at the cathode; and an electrolytic chamber containing an electrolyte, said cathode and said anode arrangement.

In accordance with the present description, there is also provided an anode arrangement for use in an electrolysis production of aluminum comprising an anode having a hollow body comprising a cavity extending longitudinally from a first end portion to a second end portion of the anode, said body having at least one gas outlet connected in fluid flow communication with the cavity; a gas inlet connected in fluid flow communication with the cavity of said anode, said gas inlet being connectable to a source of hydrogen gas for feeding hydrogen gas into the cavity of said anode; an electrical connector for generating a current at the anode during electrolysis; and a hydrogen chloride (HCl) recuperator surrounding at least a portion of the anode for recovering HCl gas released through the at least one gas outlet at an outer surface of the anode during electrolysis, the HCl recuperator having an outlet connectable to a HCl redistributor.

In accordance with the present description, there is now provided an anode arrangement for use in an electrolysis production of magnesium comprising an anode having a hollow body comprising a cavity extending longitudinally from a first end portion to a second end portion of the anode, said body having at least one gas outlet connected in fluid flow communication with the cavity; a gas inlet connected in fluid flow communication with the cavity of said anode, said gas inlet being connectable to a source of hydrogen gas for feeding hydrogen gas into the cavity of said anode; an electrical connector for generating a current at the anode during electrolysis; and a hydrogen chloride (HCl) recuperator surrounding at least a portion of the anode for recovering HCl gas released through the at least one gas outlet at an outer surface of the anode during electrolysis, the HCl recuperator having an outlet connectable to a HCl redistributor.

BRIEF DESCRIPTION OF THE DRAWINGS

Reference will now be made to the accompanying drawings, in which.

It will be noted that throughout the appended drawings, like features are identified by like reference numerals.

DETAILED DESCRIPTION

Figure 1:
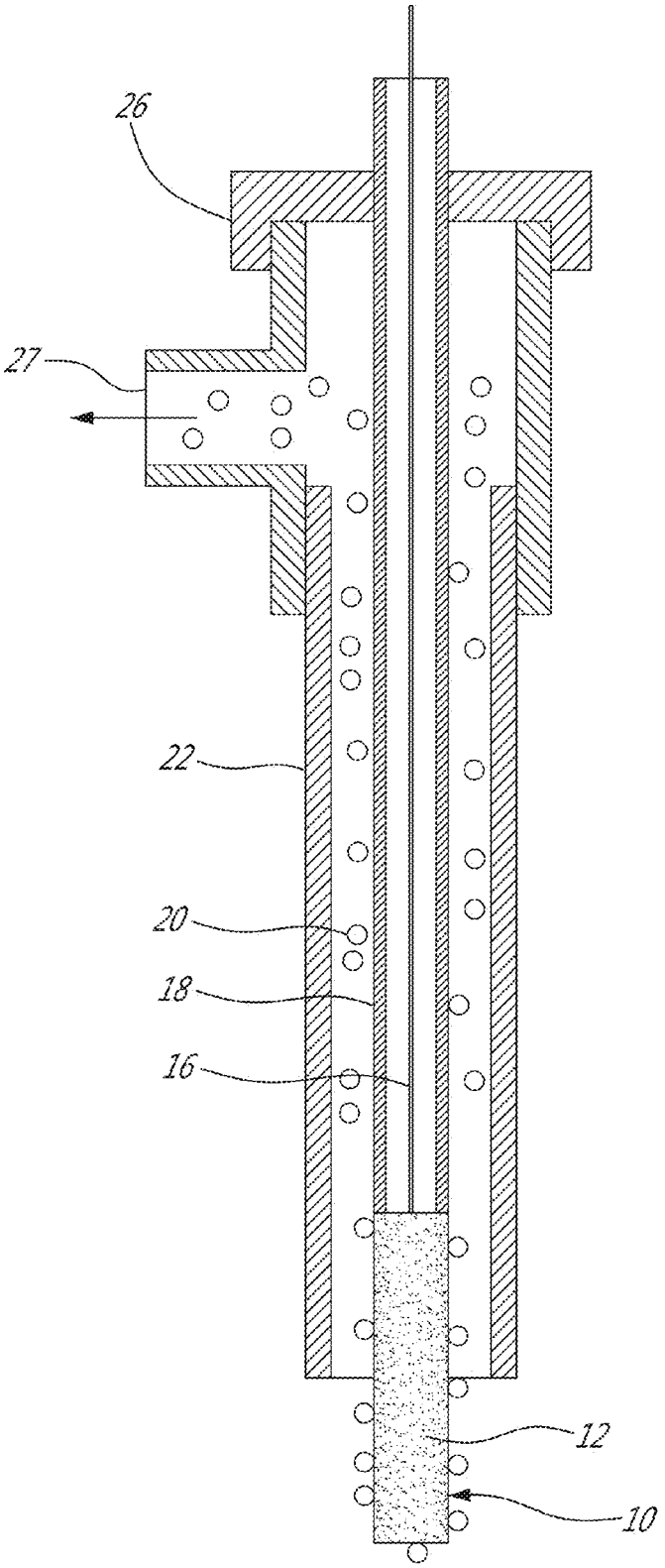
FIG. 1 is a schematic cross-sectional view of the anode arrangement according to one embodiment.

It is provided an hydrogen gas diffusion anode arrangement for use in electrolytic production of metals such as magnesium and aluminum producing hydrogen chloride (HCl) gas as a by-product.

The anode described herein can be used in extraction processes of magnesium and aluminum using hydrochloric acid which is recycled during the processes as described in International Application No. PCT/CA2013/050659 and in U.S. Patent Application No. 61/827,709, filed May 27, 2013, the content of which are incorporated by reference herein in their entirety.

During the course of electrolytic production of magnesium or aluminum, chlorine gas is formed at the anode and the metallic magnesium or aluminum being formed at the cathode. An electric current flowing through a molten electrolyte, separates the aluminum chloride or magnesium chloride into HCl which collects on the anode immersed in the electrolyte, and aluminum and magnesium metal, which collects at the cathode.

The anode is immersed into molten salt electrolyte and the HCl gas generated at the surface goes on the top of the cell. The cell is generally feed with an inert gas in order to prevent oxygen contact with the molten metal. The HCl is therein mixed with this inert gas. This very dry mixture is leaving the cell at 700° C. and could be used as a drying agent for the conversion for example of $MgCl_2$-hydrate brine into $MgCl_2$ prill. The gas is then pass throw a water scrubber (HCl redistributor) device where the HCl gas is convert to HCl liquid and the inert gas is return to the electrolytic cell after a drying step. The HCl liquid concentration is adjusted by the number of pass of the liquid in contact with the HCl charged mixing gas. When the concentration reach 32% wt, the HCl liquid solution is flush to be return to the tank and fresh water is introduce into the scrubber.

Magnesium and aluminum are presently isolated using electrolytic processes. The electrolytic reduction of molten magnesium chloride ($MgCl_2$) is a commonly used process for the production of magnesium. Two major problems are related to this process. First, it generates a large amount of $Cl_2$ which combines with the carbon of the anodes, inducing the formation of numerous organochlorine compounds most of which are part of the 12 persistent organic pollutants target for elimination by the United Nations Environment Program. Additionally, the production of magnesium requires a huge quantity of energy. Based on the free Gibbs energy of formation, a minimum power of 5.5 kWh is required for the production of 1 kg of Mg. However, by taking into account the different resistance components (electrolyte, bubbles, and electrodes) present in the system, the actual power consumption varies between 10 to 18 kWh $kg^{-1}$ depending on the cell design.

U.S. Patent Pub. No. 2002/0014416 describes the use of a high surface area anode, the anode being porous and to which hydrogen gas is fed, to produce magnesium metal by electrolysis of magnesium chloride. The design of the anode in the 2002/0014416 publication does not take into account the variance in the hydrostatic pressure exerted by the molten magnesium chloride in the electrolytic cell (prior to electrolysis). Because the anode is a vertical cell, the hydrostatic pressure exerted by the molten magnesium chloride is greater at the bottom of the anode than at the top of the anode. The hydrostatic pressure thus starts at a particular value near the top of the anode and increases towards the bottom of the anode where it is greatest. Because of this, an anode such as that of the 2002/0014416 publication (wherein the channels or pores—as the case may—are similar and equally spaced around and up-and-down across the anode) yields a structure where more hydrogen gas will exit the anode at the top (where the hydrostatic pressure is less) than will exit at the bottom (where the hydrostatic pressure is greater). This results (depending on the pressure and volume of the hydrogen gas in the cavity of the anode) either in an insufficient amount of hydrogen gas exiting the anode near the bottom or an excess amount of hydrogen gas exiting near the top. Neither situation is ideal.

Contrary to the anode described in U.S. Patent Pub. No. 2002/0014416, the anode described herein is part of an assembly that allows recuperation of HCl produced. Further, the anode described herein contains channel/pore volume which are varied to compensate for the variance in the hydrostatic pressure presented by molten magnesium for example. Thus, in the anode disclosed herein, nearer to the top of the anode (where the hydrostatic pressure is less) the anode comprises a smaller channel/pore volume. Nearer to the bottom of the anode (where the hydrostatic pressure is greater) the anode comprises a greater channel/pore volume. Preferably, the channel/pore volume will progressively increase as one progresses down the length of the anode from top to bottom. The channel/pore volume can be calculated and will increase proportionally with the increase in hydrostatic pressure—thus attempting to ensure that substantially the same amount of hydrogen gas exits the anode across its external surface area whatever the distance be from the top/bottom of the anode. This results in a sufficient amount of hydrogen gas exiting the anode, reducing or eliminating the attack by chlorine gas on the carbon in the anode, reducing or eliminating the production of chlorinated carbon compounds, reducing or eliminating the production of chlorine gas and substituting therefor the production of hydrogen chloride gas, and reducing the voltage required with respect to the electrolysis of the magnesium chloride or aluminum chloride without requiring an excess of hydrogen gas.

The cell reaction in aluminium chloride electrolysis is:

$$2AlCl_3 \rightarrow 2Al + 6Cl_2$$

For this reaction at 700° C., the reversible decomposition voltage works out to be about 1.8 volts.

For the extraction of aluminum, the overall reaction becomes:

$$2AlCl_3 + 3H_2 \rightarrow 2Al + 6HCl \quad \text{(eq. 1)}$$

During conventional magnesium electrolysis, $MgCl_2$ decomposes into liquid magnesium at the cathode and gaseous chlorine at the anode according to the Eq. 1. In this case, the theoretical voltage of the reaction is 2.50 V.

$$MgCl_2 \rightarrow Mg + Cl_2 \quad \text{(eq. 2)}$$

For the process using hydrogen gas diffusion anode, the overall reaction becomes:

$$MgCl_2 + H_2 \rightarrow Mg + 2HCl \quad \text{(eq. 3)}$$

For such a reaction, the decomposition voltage decreases to 1.46 V, allowing a theoretical voltage reduction of about 1V, the overall cell voltage could reach a reduction of 0.86 V. This represents a reduction of 25% in energy consumption.

One important benefit provided by the anode described herein is the production of HCl as by-product of the process. Since the purification process of $MgCl_2$ and $AlCl_3$ ores consumes gaseous HCl for the dehydration step, this is of great interest to produce on-site the HCl required for this process. This lead to economic benefits and a simplification of the process because the amount of HCl produced by electrolysis should be sufficient to feed the chemical reactor for the dehydration process. The theoretical amount of HCl which can be produced during magnesium electrolysis can be estimated from Eq. 4:

$$Q = \frac{i \times t}{n(e-) \times F} \quad \text{(eq. 4)}$$

where i is the current (A), $n(e^-)$ the number of electron exchanged (in the present case $n(e^-)=1$ per mole of HCl), F the Faraday constant and t the electrolysis time (s). Thus, the maximum amount of HCl which could be extracted from the electrolysis process and supplied to the $MgCl_2$ or $AlCl_3$ purification facilities may theoretically reached 37.3 $10^{-3}$ mol $h^{-1}$ $A^{-1}$. Therefore, for one electrochemical cell running at 300 kA, about 410 kg of gaseous HCl could be produced per hour and used for the extraction of magnesium and aluminum.

Additionally, the formation of HCl instead of $Cl_2$ at the anode could drastically reduce the formation of undesirable organochlorine compounds, leading to a more ecological process and best fitting the increasing restriction concerning the greenhouse gas emissions. As additional benefit, by reducing the reaction of chlorines with the carbon of the anode, the life time of this one will be increased, leading to a decrease of the anode replacement frequency and consequently to a lower Mg production cost.

Referring to FIG. 1, it is shown in an embodiment an anode 10 as encompassed herein.

Anodes for the electrolysis could be made, as encompassed herein, of a self-sustaining matrix of sintered powders of at least one oxy-compound such a soxides, multipleoxides, mixed oxides, oxyhalides and oxycarbides, of at least one metal selected from the group consisting of lanthanum, terbium, erbium, ytterbium, thorium, titanium, zirconium, hafnium, niobium, chromium and tantalum and at least one electroconductive agent, the anode being provided over at least a portion of its surface with at least one electrocatalyst for the electrolysis reaction and bipolar electrodes for the cells which electrodes are resistant to corrosion in molten salt electrolysis and have a good electroconductive and good electrocatalytic activity.

The anode 10 has an elongated body 12. The body 12 can be made of graphite for example, preferably porous graphite. The body can be of any shape, such has being cylindrical. The shape of the anode ideally needs to be easy to machine, present a homogenous gas distribution at its surface and fit easily with electrochemical cell components. Alternatively, the anode body can be a metal diffuser, fabricated from sintered metal powders, leading to interconnected porosity through which the gas is able to diffuse. The bubbles generated at the surface are homogeneously distributed and their size can be easily varied with the pore diameter. Sintered metal diffusers are available in a large choice of materials and in different ranges of porosity, such as for example Hastalloy X. Pore size of as low as 5 μm can be used in such metal diffuser.

The anode 10 is inserted in a tube 22 consisting of a HCl recuperator closed at one extremity by a cap 26. The HCl recuperator 22 is for example a sintered alumina tube of 1 inch. The cap 26 can be a T-shape Swagelok fitting as depicted in FIG. 1. As seen in FIG. 1, the gas bubble 20 produced at the surface of the anode 10 stay constrain inside the alumina tube and have no other choice than going up inside the HCl recuperator 22. The anodic gases 20 are separated from the magnesium or aluminum produced at the cathode preventing any back reaction. Gases 20 formed at the anode are then transferred into a HCl redistributor through the gas outlet 27. Experimentally, a bubbler is used to recuperate the HCl gas through the gas outlet 27 in order to measure the level of HCl produced. The bubbler can be filled with a NaOH solution. An acid-base titration of the NaOH solution after electrolysis is performed for the quantification of the produced HCl.

Figure 2:
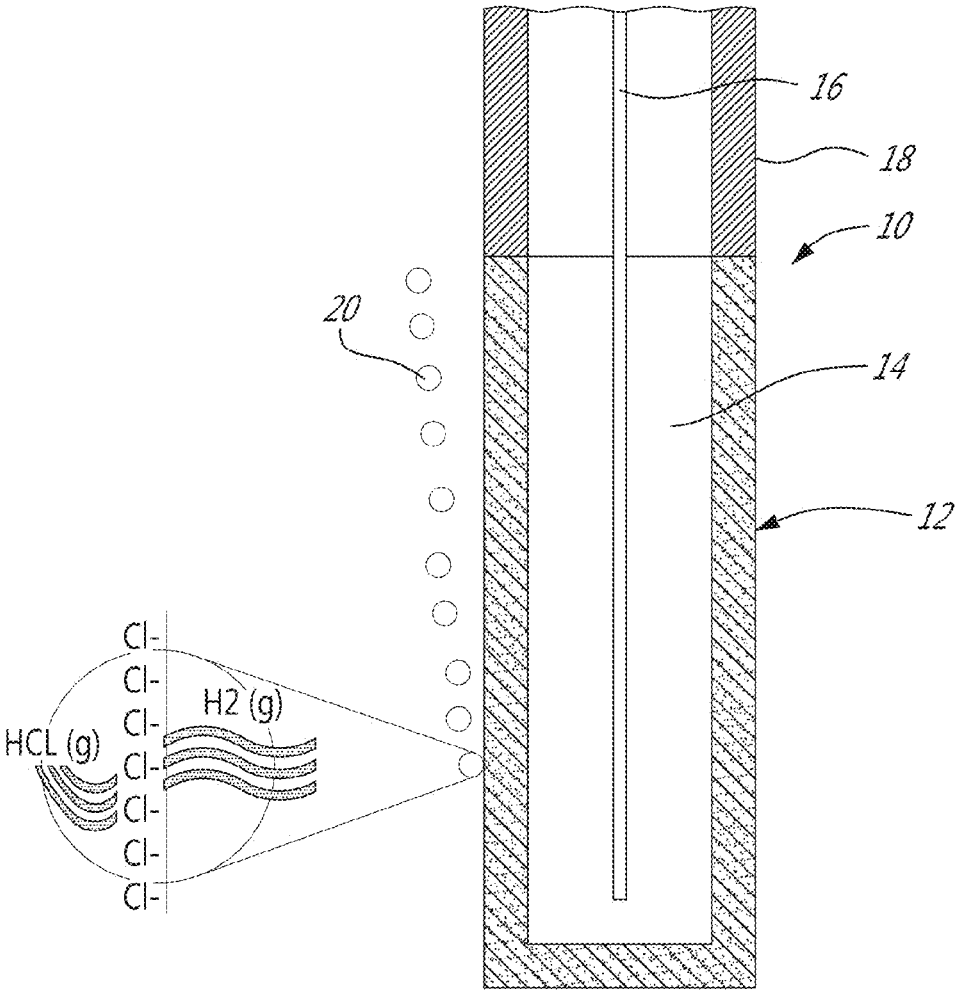
FIG. 2 is an enlarge section view of an anode connected to a gas inlet as per the he anode arrangement of FIG. 1.

Within the body 12 of the anode 10, there is a longitudinal cavity 14 (as seen in FIG. 2) to which is connected a gas inlet connector 18 for feeding hydrogen gas. The gas inlet 18 can be connected for example on top of the anode 10 or at the bottom of the anode 10. When connected at the bottom of the anode 10, the hydrogen gas can be bubbled in the anode 10 from the gas inlet 18. The gas inlet 18 can be protected by the HCl recuperator 22. The gas inlet connector 18 can be made of stainless still and can also act as a HCl recuperator. Accordingly, the HCl recuperator 22 and the gas inlet connector 18 can be the same tube. The anode 10 further comprises an electrical connector 16 passing through the gas inlet through the longitudinal cavity of the anode 10 (FIG. 2).

Figure 3A:
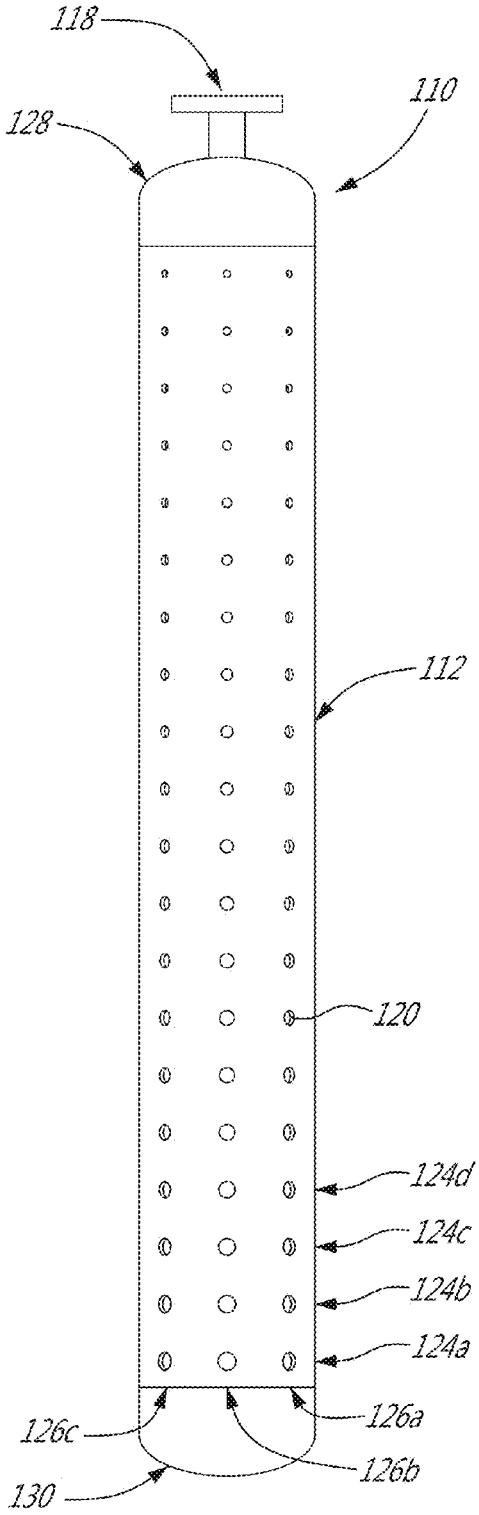
FIG. 3A is a side view of an anode in accordance to an embodiment.
Figure 3B:
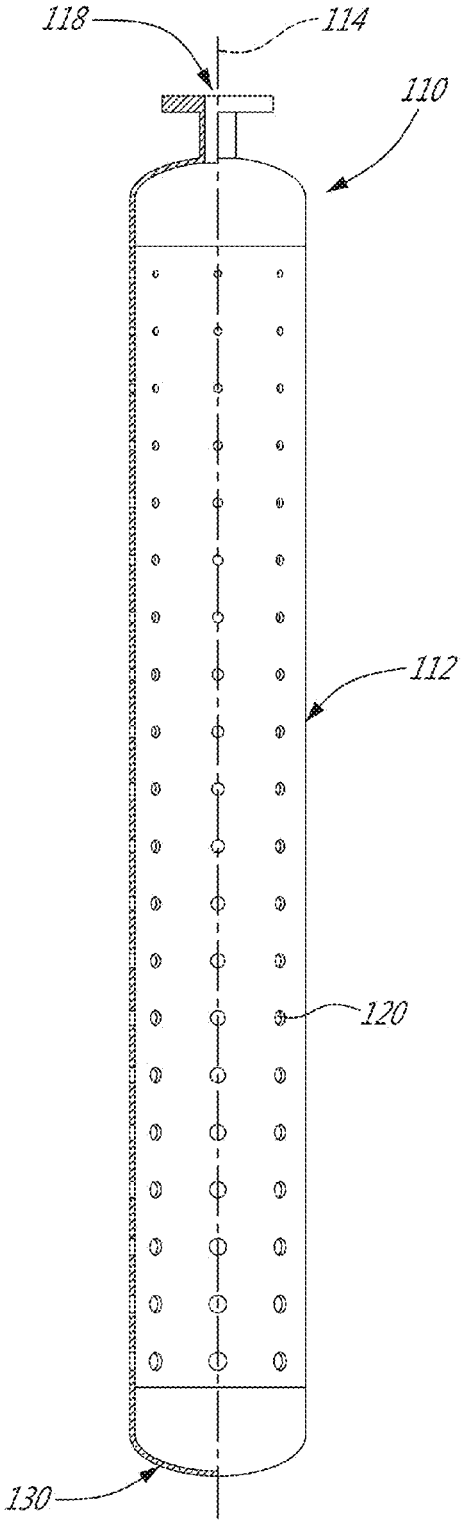
FIG. 3B is a section view of the anode of FIG. 3A.

In an embodiment, as seen in FIG. 3A, the anode 110 connected to a gas inlet 118, comprise, along the body 112, are a series of channels 120. The channels 120 extend from the exterior surface of the body 112 to the longitudinal cavity 114 (FIG. 3B). The channels 120 thus form a series of gas outlets. The channels are arranged generally symmetrically around the body 112 in a series of row 124 and columns 126. The channels 120 are formed as right circular cylindrical bores in the body 112. Within each row 124 (e.g. within row 124*a*) each of the channels 120 has generally the same volume (e.g. the diameter of each channel 120 is basically the same). Within each column 126 (e.g. within column 126*a*) the volume of the channels 120 increases as one progresses from the top 128 to the bottom 130 of the body 112 (e.g. the diameter of each channel 120 increases as one progresses from top 128 to bottom 130).

Figure 4A:
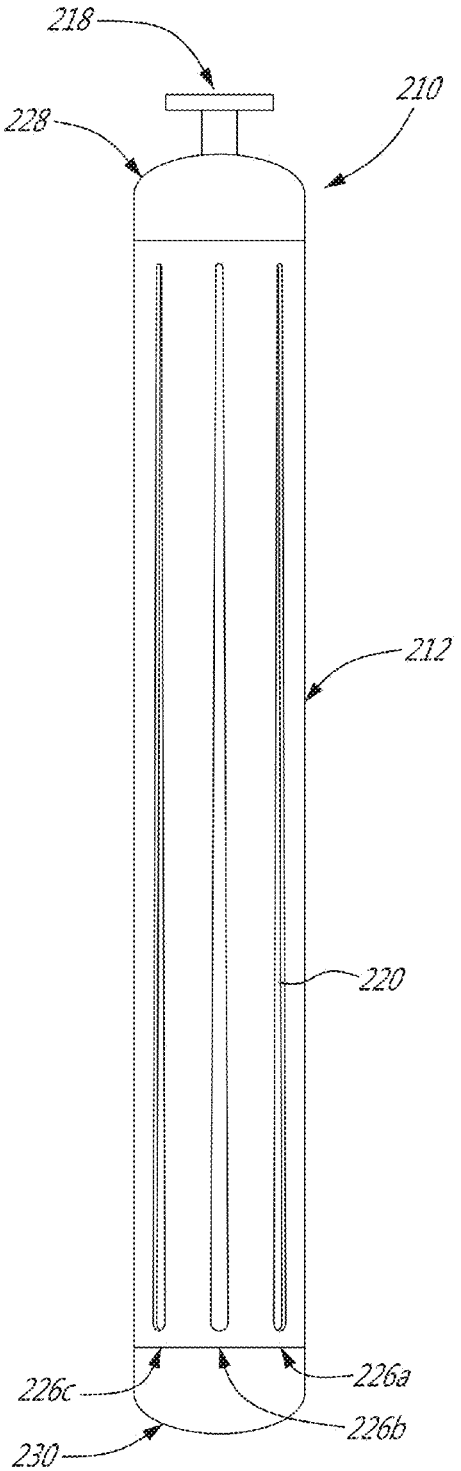
FIG. 4A is a side view of an anode in accordance to another embodiment.
Figure 4B:
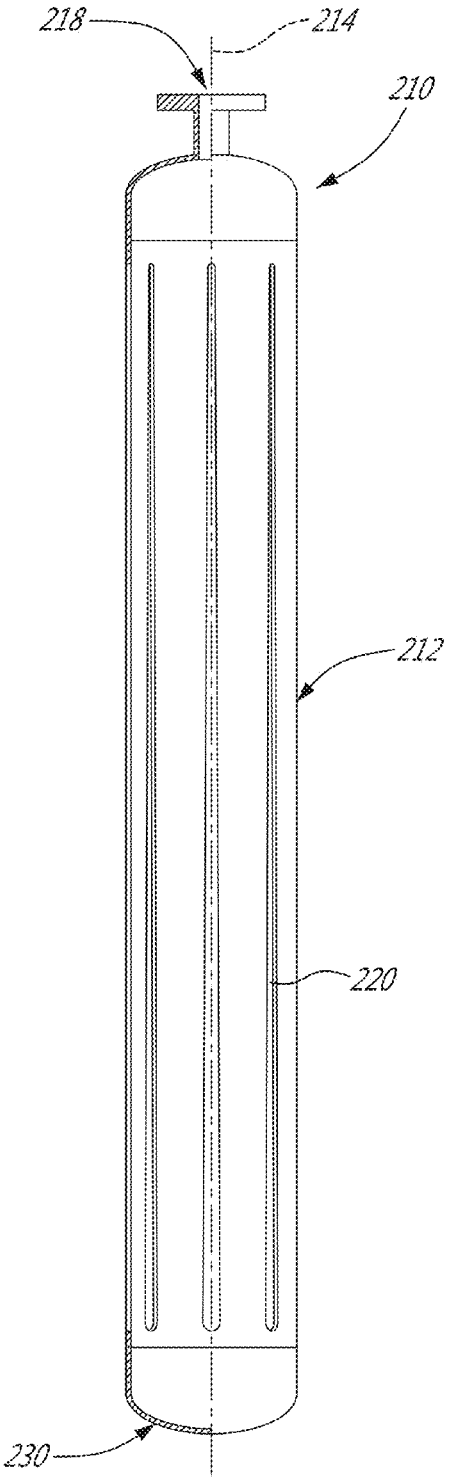
FIG. 4B is a section view of the anode of FIG. 3A.

In an alternative embodiment, referring to FIGS. 4A and 4B, an anode 210 connected to a gas inlet 218 is disclosed having an elongated right circular cylindrical body 212 made of graphite. The body 212 comprises a series of channels 220. The channels 220 thus form a series of gas outlets. The channels 220 are arranged generally symmetrically around the body 212, extending from the exterior surface of the body 212 to the longitudinal cavity 214. The channels 220 are elongate and taper from the bottom 230 to the top 228 of the body 212. Each channel 220 (labels as 226*a*, 226*b*, 226*c*, etc.) is generally of the same size and shape.

It is demonstrated that a significant cell voltage reduction and in-situ generation of HCl can be obtained by using the hydrogen anode as described herein. The conversion efficiency of the reaction corresponds to the ratio of the HCl produced experimentally to the theoretical HCl production. The theoretical HCl production was calculated by taking into account the theoretical amount of $Cl_2$ produced from the Faraday's law and the amount of $H_2$ injected through the anode. In order to obtain the experimental HCl produced, short electrolysis tests were performed at different current densities with a gas flow rate at the anode varying from 376 to 845 $cm^3$ $min^{-1}$ for the Ar-5% $H_2$ gas mixture and 9 to 30 $cm^3$ $min^{-1}$ for pure $H_2$.

The fact that the conversion rate is approaching 80% at 0.5 A $cm^{-2}$ indicates that it is a viable solution for in-situ HCl production for the dehydration of $MgCl_2$ or $AlCl_3$. A significant voltage reduction of 0.2-0.4 V is obtained depending on the current density. Keeping in mind the huge power consumption of the Mg electrolysis process for example, even if minimal, the reduction of the cell voltage may represent an attractive benefits giving rise to a significant cost saving. Best results were obtained with a carbon anode with graphitic plans perpendicular to the electrode axis through which hydrogen diffuses to generate tiny and relatively well-distributed $H_2$ bubbles on the anode surface.

The hydrogen anode can be further modified by maximizing the gas diffusion through the graphitic anode. The incorporation of an electrocatalyst in the anode to decrease the overpotential for $H_2$ oxidation and thus the cell voltage is also encompassed.

The present disclosure will be more readily understood by referring to the following examples which are given to illustrate embodiments rather than to limit its scope.

Example I

Fabrication of Different Types of Anode

4-Hole Graphite Anode

Four holes were drilled on the edge of the lower part of the anode. This kind of electrodes presents the main advantage of being cheap, quickly and easily machined. However, as the holes were relatively large (about 0.3 mm in diam.), the bubbles generated are large in size, heterogeneously distributed and diffuse very fast on the surface of the anode. In order to slow down the diffusion of the bubbles on the anode surface, digs were machined perpendicularly to the axe of the anode.

Sintered Metal Diffuser Anode

The second type of hydrogen gas diffusion anode evaluated was a metal diffuser. This anode was fabricated from sintered metal powders, made of Hastalloy X, leading to interconnected porosity through which the gas is able to diffuse. Such an anode is very attractive because the bubbles generated at the surface are homogeneously distributed and their size can be easily varied with the pore diameter. In order to obtain the smallest bubbles, the finest available pore size of about 5 μm were chosen. The pore distribution size could be adapted along the surface to take into account the hydrostatic pressure variation from top to bottom of the electrolytic cell.

Porous Graphite Anode

For the last type of electrodes, porous graphite anodes were evaluated. This kind of electrode consist of a graphite rod drilled along its axis in order to give wall thickness of about ⅛". To prevent any $H_2$ leaks at the gas inlet connector tube/graphite interface, the upper part of the graphite electrode was machined to give exactly the same diameter than the inside diameter of the gas inlet connector tube. Then, the lowermost part of the gas inlet connector tube was heated leading to its thermal expansion, allowing the graphite electrode to be inserted. During cooling, the gas inlet connector tube contracted around the graphite electrode leading to a strong and leak-free connection between the two parts. To protect the stainless tube against corrosion appearing close to the gas inlet connector tube/graphite interface, this area was protected by a sintered alumina tube while the upper part was protected by alumina cement.

Bubbling tests in water demonstrated that hydrogen diffuses well through the electrode, leading to the formation of very small bubbles on the anode surface. This kind of anode was tested as hydrogen gas diffusion anode for Mg electrolysis. Subsequently, in order to optimize the size and the distribution of the $H_2$ bubbles on the surface of the electrode, several pieces of graphite were machined from a large block of graphite according to different orientations. This provides graphite rods with a preferential orientation of the graphitic plans perpendicular to the electrode axis, where hydrogen bubbles were well distributed on the anode surface and where no growth of large bubbles was observed.

The graphitisation level for synthetic graphite determine the level of orientation of graphite plan among the cross section of the anode. This graphitization level is the result of parameter such as temperature, pressure and reaction time while anode manufacturing. This property could be use to control the channeling-porosity along the anode for hydrostatic pressure control.

Example II

Electrolysis Tests with 4-Hole Hydrogen Gas Diffusion Anode

Figure 5:
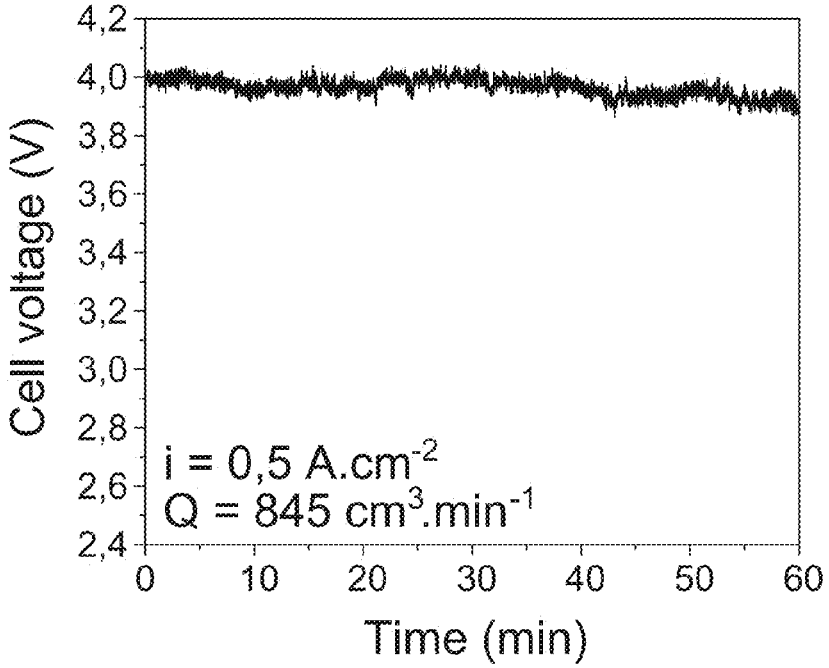
FIG. 5 is graphical representation of the measured cell voltage in view of the electrolysis time at 0.5 A $cm^{-2}$ and 845 $cm^3$ $min^{-1}$ with a 4-hole hydrogen anode.

Graphite anode drilled with 4 holes on the edge of the lowermost part of the rod and presenting digs was evaluated as hydrogen anode for magnesium production. Electrochemical measurements were conducted at 700° C. with the apparatus for the gas capture as described previously. Electrolysis test conducted at 0.5 $A \cdot cm^{-2}$ for one hour with an Ar-5% $H_2$ flow rate of 845 $cm^3 \cdot min^{-1}$ demonstrated a stable behavior as shown in FIG. 5. The cell voltage is around 4.0 V. The short time variation of the voltage with a maximum amplitude 0.1V can be attributed to the high gas flow rate. These perturbations were not observed with a lower flow rate (e.g., 376 $cm^3$ $min^{-1}$). The lower cell voltage observed in this case, compared to an electrolysis without hydrogen is due to a lower current density and most of all, by the fact that alumina tube surrounding the anode causes a lower resistance than the separation wall.

Figure 6:
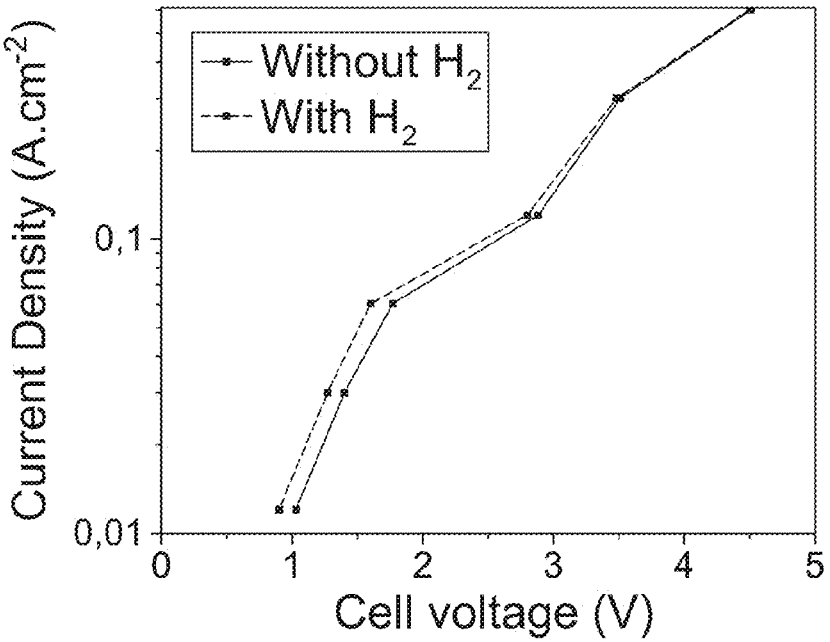
FIG. 6 is a graphical representation of the measured Tafel plots for a 4-hole anode with 376 $cm^3$ $min^{-1}$ Ar-5$H_2$ and without $H_2$.

In order to evaluate the effect of hydrogen on the cell voltage, short time chronopotentiometric measurements at different current densities were performed with and without hydrogen. For this experiment, the cell voltage was first recorded without hydrogen until it reached a stable voltage and then 376 $cm^3 \cdot min^{-1}$ of Ar-5$H_2$ was injected through the anode. The evolution of the cell voltage with the current density is shown in FIG. 6.

It was observed that the use of a $H_2$ anode induces a decrease of the cell voltage. However, the voltage diminution is much lower than predicted by the thermodynamic calculation and tends to decrease with the increasing current density. Indeed, the difference between the two curves disappears to give the same value of 4.5V at 0.6 A $cm^{-2}$. However, the fact that a significant reduction of 0.15 V of the cell voltage can be observed at low current density is promising considering the use of a non-optimized $H_2$ anode.

Example III

Electrolysis Tests with a Sintered Metal Diffuser Anode

Figure 7:
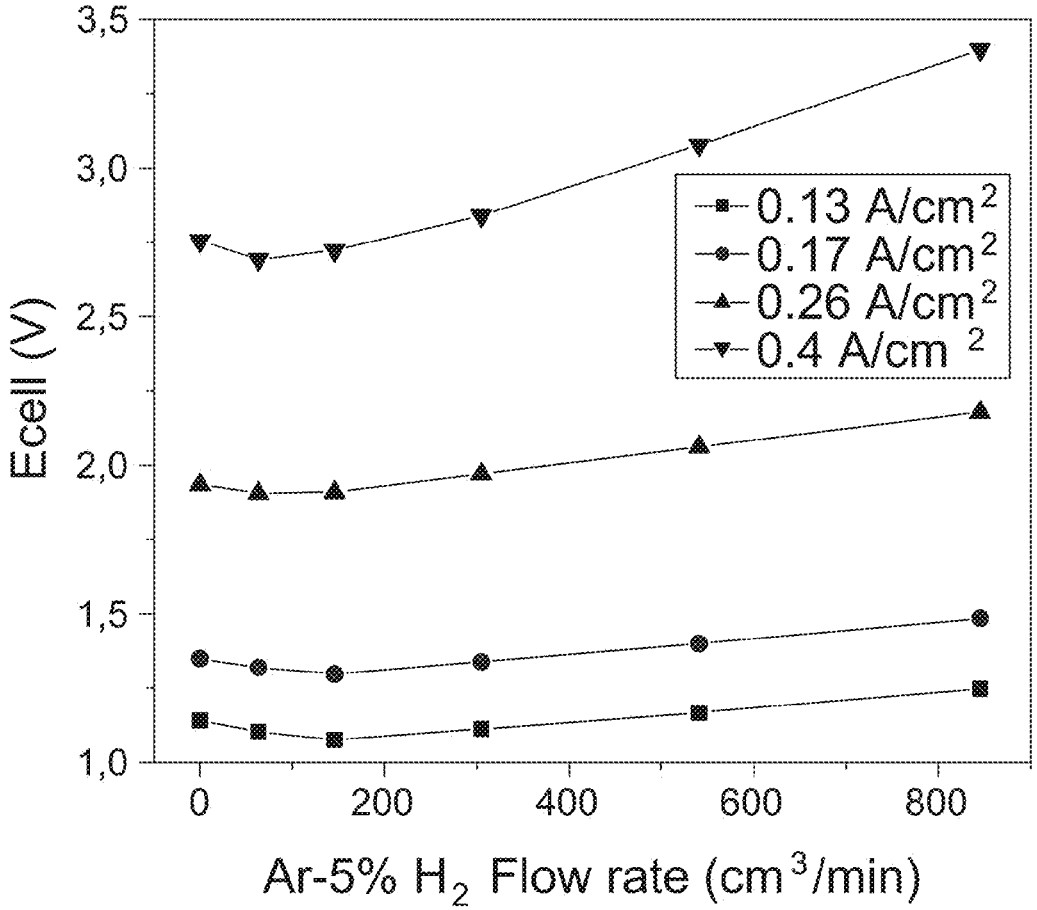
FIG. 7 is a graphical representation of the measured evolution of the cell voltage as a function of the gas flow rate for different current densities (from 0.13 to 0.4 A·$cm^{-2}$) with a sintered metal diffuser anode.

Electrochemical measurements were realized with an anode made of Hastalloy X generally employed to resist to high temperature corrosive environments. Compared to the previous type of electrode, sintered metal diffusers have the advantage of diffusing gas very homogeneously. Thus, hydrogen bubbles generated at the anode surface are very small and well distributed. Chronopotentiometric measurements were carried out with different flow rates of Ar-5% $H_2$ and at various current densities. The evolution of the cell voltage with the gas flow rate for different current densities is plotted in FIG. 7. For all current densities, a slight decrease of the cell voltage reduction is observed at a low gas flow rate (65-145 $cm^3$ $min^{-1}$). Even if the observed voltage reduction is smaller (<0.1 V) compared to the previous case (0.15 V), it can be observed for a current density as high as 0.4 A $cm^{-2}$. This confirms that a fine gas diffusion permits to obtain a voltage reduction at high current density. Furthermore, every curve depicts the same behavior with a minimum cell voltage obtained for an Ar-5$H_2$ flow rate between 65 and 145 $cm^3 \cdot min^{-1}$. At higher gas flow, for every current density, the cell voltage drastically increases. This is attributed to the high gas flow rate which, in the case of a homogeneous distribution of small bubbles on the overall surface of the electrode, must generate a resistive layer. This is of great interest because it indicates that the flow rates used until now are too high and are not appropriated for a gas diffusion anode. However, low flow rates with a gas mixture containing only 5 at % $H_2$ do not provide enough hydrogen for the electrolysis reaction which can also explain the small voltage reduction observed previously. Ideally, pure hydrogen has to be used in order to obtain a significant cell voltage reduction.

Example IV

Electrolysis Tests with a Porous Graphite Anode

Porous graphite represents the most promising type of hydrogen anodes for magnesium electrolysis tested. No noticeable trace of corrosion were found on the carbon anodes. Thus, it appears that carbon represents an ideal choice of anode material for magnesium electrolysis because of its excellent corrosion resistance at high temperature in $MgCl_2$ based molten salt. In addition, it was observed that hydrogen was capable of diffusing through the electrode wall providing a good distribution of small bubbles at the surface of the electrode. However, the first tests were conducted with a carbon rod in which the hydrogen seems to diffuse preferentially along the axis of the rod leading to a higher concentration of bubbles at the bottom part of the electrode. Knowing that the most common process for producing carbon rod is hot extrusion, it can be assumed that gas diffuses preferentially along the axis of extrusion. In a second part, measurements with anode presenting a preferential gas diffusion perpendicularly to the axis of the rod were conducted. Preliminarily examination of the gas diffusion (by immersion in water) has shown that the bubbles are homogeneously distributed on the anode surface and the growth of large bubbles at the bottom part of the electrode is not observed.

Figure 8B:
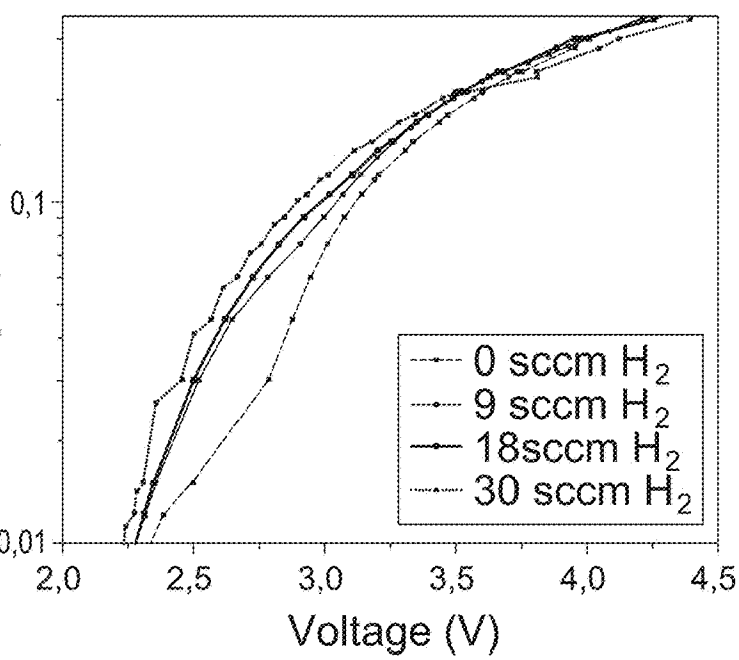
FIG. 8B is a graphical representation of the measured Tafel plots for experiments at 700° C. with carbon anode with a preferential gas diffusion along the axis of the electrode and for $H_2$ flow rates of 0, 9, 18 and 30 $cm^3$ $min^{-1}$.
Figure 8A:
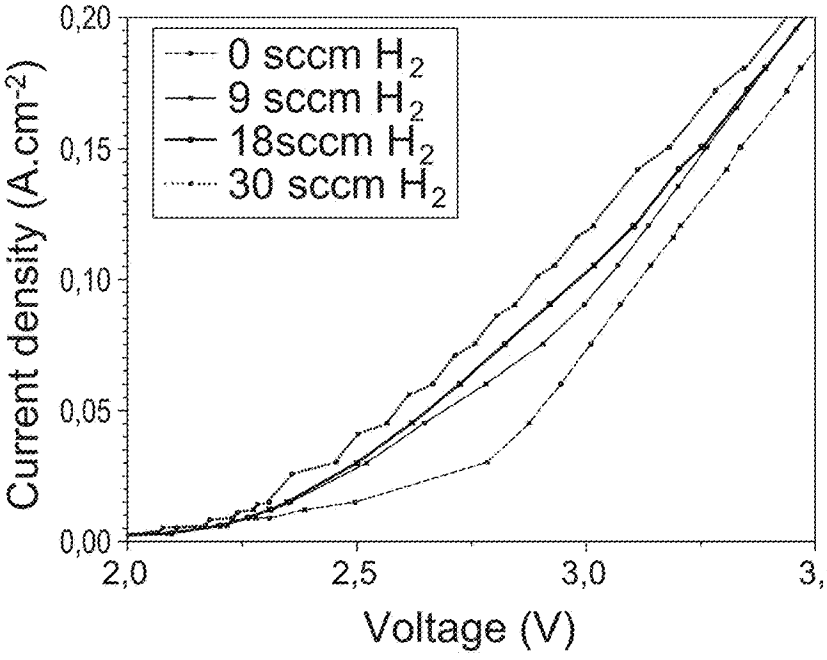
FIG. 8A a graphical representation of the measured evolution of the cell voltage as a function of the current density with a carbon anode, with a preferential gas diffusion along the axis of the electrode and for $H_2$ flow rates of 0, 9, 18 and 30 $cm^3$ $min^{-1}$.

The influence of the hydrogen flow rate on the cell voltage was measured. For that purpose, short chronopotentiometry measurements (1 to 5 min) at 700° C. were carried out at different current densities and with different pure $H_2$ flow rates. The variation of the cell voltage as a function of the current density for 0, 9, 18 and 30 $cm^3$ $min^{-1}$ $H_2$ is plotted in FIG. 8A and their corresponding Tafel representations are presented in FIG. 8B. It can be observed that at low current densities, the presence of hydrogen at the surface of the anode has a noticeable effect on the cell voltage. However, as the current density increases, the effect of hydrogen tends to decrease until approximately 0.2 A $cm^{-2}$ where the presence of hydrogen seems to have no significant influence on the cell voltage.

For low current densities, it can be seen that the cell voltage tends to decrease as the $H_2$ flow rate increases. The highest potential decrease (0.35V) is obtained for a $H_2$ flow rate of 30 $cm^3$ $min^{-1}$ at a current density of 0.03 A $cm^{-2}$. This indicates that the cell reaction is not optimal and it could certainly be improved by a better distribution of the $H_2$ bubbles at the surface of the electrode.

On the other hand, even if the highest cell voltage reduction was obtained for the highest $H_2$ flow rate of 30 $cm^3 \cdot min^{-1}$, it can be noted that reduction of the cell voltage becomes less significant with increasing $H_2$ flow rate. Indeed, the cell voltage decrease while the H2 flow rate increases from 0 to 9 $cm^3$ $min^{-1}$ is far greater (0.25V) than between 9 and 30 $cm^3$ $min^{-1}$ (0.1 V).

In order to reach a cell voltage reduction at high current, the anodic oxidation of $H_2$ must be favored for instance by increase the effective surface area of the anode (resulting in a decrease of the current density) or/and by adding an electrocatalyst for $H_2$ oxidation (resulting in a decrease of the anodic overpotential).

The conversion efficiency was calculated by comparing the amount of HCl produced during electrolysis with the amount of HCl theoretically produced.

The amount of hydrogen gas injected through the anode is controlled by a flow meter. Depending on the pressure inside the gas transportation pipe, the flow rate can be easily corrected by using a conversion table. The accuracy of a ball flow meter is limited to ±1-2 $cm^3$ $min^{-1}$ which therefore has a slight influence on the calculation of the theoretical produced HCl. Assuming that the amount of HCl which can be produced only depends on the $H_2$ flow rate, the theoretical molar flow rate of produced HCl follow a linear law as represented by the black solid line in FIG. 9.

The second factor which may limit the formation of HCl is the $Cl_2$ produced at the anode during the electrolysis tests considering that HCl may also be produced by the reaction: $H_2+Cl_2=HCl$. The theoretical production of $Cl_2$ can be calculated from the faraday law which depends on the anodic current. After calculation, it can be found that for a current density of 0.5 A $cm^{-2}$, the amount of produced $Cl_2$ is in excess for $H_2$ flow rates of 9 and 18 $cm^3$ $min^{-1}$ and is equimolar for 30 $cm^3$ $min^{-1}$. At 0.5 A $cm^{-2}$ and for all studied flow rates, the reaction is only limited by the $H_2$ flow rate. On the other hand, at a current density of 0.25 A $cm^{-2}$, the conversion reaction occurs with an excess of $Cl_2$ at 9 $cm^3$ $min^{-1}$, is equimolar at 15 $cm^3$ $min^{-1}$ and therefore, occurs with an excess of $H_2$ for higher flow rates (i.e. 18 and 30 $cm^3 \cdot min^{-1}$) as illustrated by the break in the linearity of the solid line in FIG. 9B. Thus, the two black solid lines shown in FIGS. 9A-B indicate the maximum amount of HCl which can be produced for a given condition.

Figure 9B:
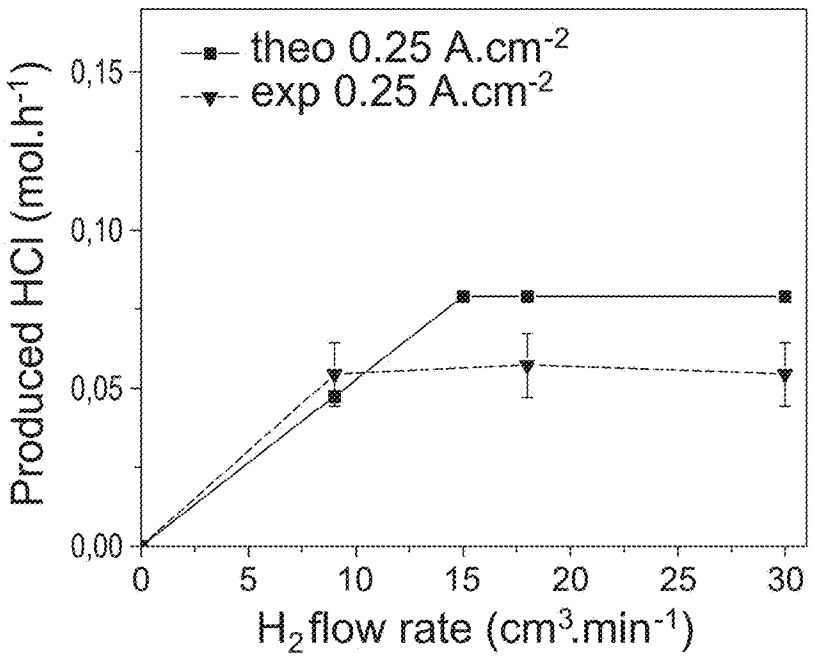
FIG. 9B is a graphical representation of the measured evolution of the theoretical and experimental produced HCl in function of the hydrogen flow rate for 0.25 A·$cm^{-2}$.
Figure 9A:
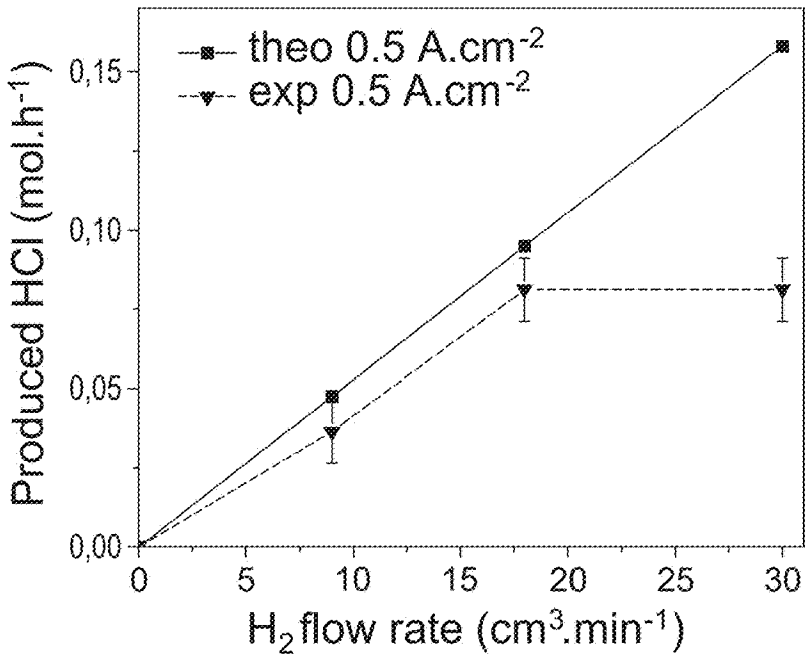
FIG. 9A is a graphical representation of the measured evolution of the theoretical and experimental produced HCl in function of the hydrogen flow rate for 0.5 A·$cm^{-2}$.

The dotted lines plotted in FIGS. 9A-B represent the experimental data of the produced HCl quantified by acid-base titration. For a current density of 0.5 A $cm^{-2}$ (FIG. 9A), it was observed that the quantity of produced HCl increases as the $H_2$ flow rate increases up to 18 $cm^3$ $min^{-1}$ and furthermore is very close to the theoretical line, indicating a high efficiency of conversion. Thus, in the range 0-18 $cm^3$ $min^{-1}$, the conversion efficiency was found to be comprised between 77 and 85%. For a $H_2$ flow rate of 30 $cm^3$ $min^{-1}$, the HCl production does not increase and as a consequence, the efficiency of conversion drastically decreases to about 50-60%. In fact, the plateau observed after 18 $cm^3$ $min^{-1}$ can be related to the faradic yield of the Mg electrolysis reaction. Actually, by taking into account a faradic yield of 66% as observed during the first experiment, a maximum HCl production of 0.1 mol $h^{-1}$ was found which corresponds to a $H_2$ flow rate of 18 $cm^3$ $min^{-1}$. So it is not surprising to observe that the HCl production does not increase at a $H_2$ flow rate higher than 18 $cm^3$ $min^{-1}$ and additionally, it tends to confirm that the faradic yield of the Mg electrolysis reaction is closed to 66%. This also means that the formation of HCl through the chemical reaction $H_2+Cl_2=HCl$ does not occur because if this latter occurs, the amount of produced HCl should be independent of the faradic yield of the Mg electrolysis.

For a current density of 0.25 $A \cdot cm^{-2}$ (FIG. 9*b*), it can be observed that at 9 $cm^3$ $min^{-1}$, the conversion rate is very high (close to 100%) and the amount of HCl produced reached 0.055 mol $h^{-1}$. Like the previous case, once this value is reached no more HCl can be produced. As the current density is half lower than in the previous experiment, it is not surprising to obtain a maximum value for the HCl produced which is also half lower (0.055 mol $h^{-1}$), and corresponds to a faradic yield for the Mg electrolysis of about 70%.

Thus, it can be considered that the conversion efficiency of the process is very high, between 80 and almost 100%. On the other hand, the relatively poor faradic yield of the Mg electrolysis observed during the tests should not be seen as an end since industrial electrolysis cells usually run with faradic yield by far higher thanks to their optimized design and operation conditions. In this way, if assumed that a faradic yield of 90% and a conversion efficiency of 90% can be obtained in an industrial cell, it can be estimated that about 365 kg $h^{-1}$ of HCl could be produced by an electrochemical cell running at 300 kA.

Figure 10A:
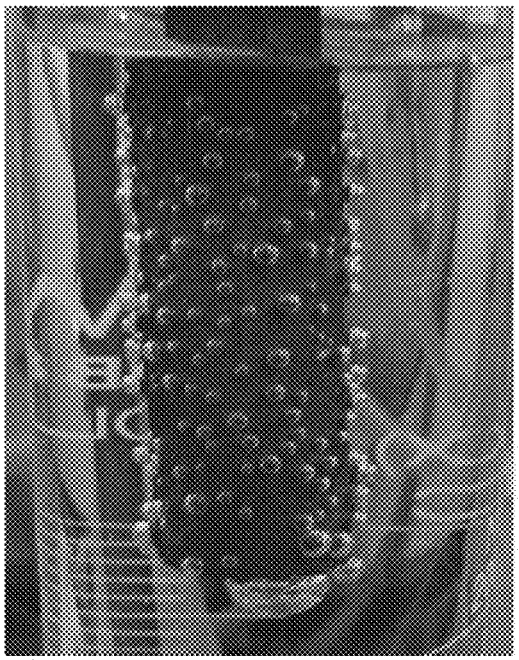
FIG. 10A is a photographic representation of a bubbling test into water for a porous electrode with a preferential diffusion along the axis of the electrode.
Figure 10B:
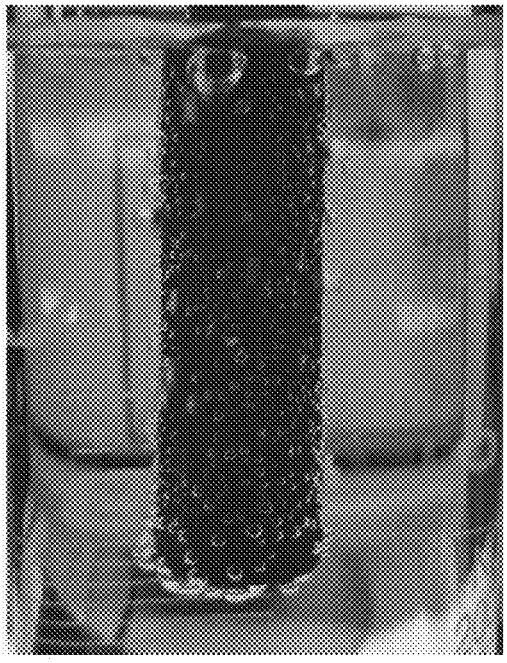
FIG. 10B is a photographic representation of a bubbling test into water for a porous electrode with a preferential diffusion perpendicular to the electrode.

The use of porous carbon anodes with a preferential gas diffusion perpendicular to the anode axis was investigated. FIG. 10 shows the two electrodes under a gas flow rate of 30 $cm^3 \cdot min^{-1}$ during a bubbling test into water. In FIG. 10A, the electrode with preferential gas diffusion along the anode axis presents a large bubble on the bottom part of the rod with smaller bubbles dispersed around the cylinder. By comparing it with an electrode presenting preferential diffusion perpendicular to the axis (FIG. 10B), it can be observed that the bubble dispersion is more homogeneous. Such an electrode presents a superior number of smaller bubbles surrounding the overall surface. On the lowermost part, no large bubbles were observed but only small ones. Note that the bubble homogeneity could be further increased by using a carbon with smaller size of pores.

Figure 11:
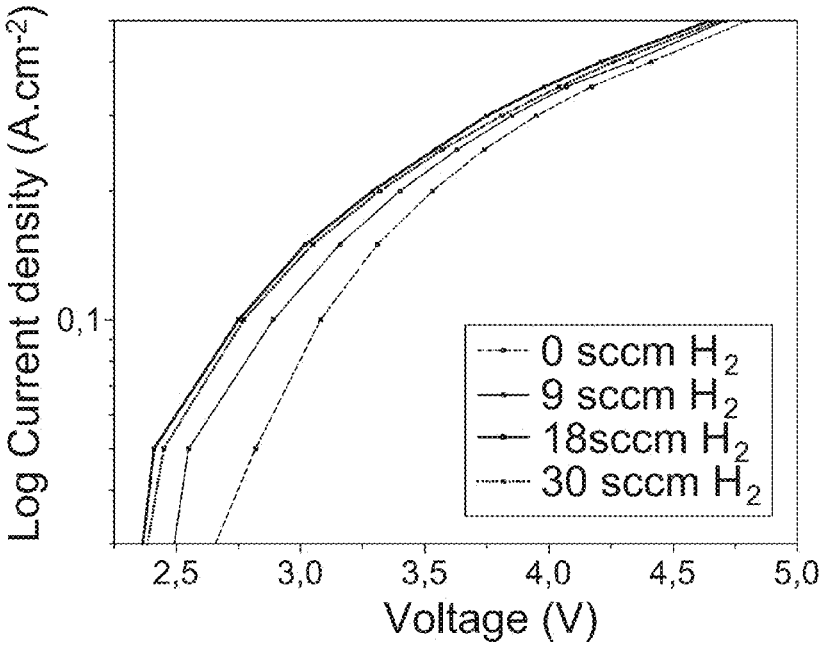
FIG. 11 is a graphical representation of the measured Tafel plots at 700° C. with a carbon anode with a preferential gas diffusion perpendicular to the axis of the electrode for $H_2$ flow rates of 0, 9, 18 and 30 $cm^3$·$min^{-1}$.

Chronopotentiometric measurements were conducted in order to evaluate the influence of the distribution and the size of hydrogen bubbles generated at the surface of the electrode. The evolution of the cell voltage as a function of the current density with a $H_2$ flow rate varying from 0 to 30 $cm^3$ $min^{-1}$ is depicted in FIG. 11. As observed previously, it appears that the presence of hydrogen at the surface of the electrode leads to a significant decrease of the cell voltage. Additionally, by comparing the curves for 0, 9 and 18 $cm^3$ $min^{-1}$, it can be seen that the higher the hydrogen flow rate is, the higher the voltage reduction is. However, increasing the gas flow rate to 30 $cm^3$ $min^{-1}$ does not induce further reduction of the cell voltage. As shown previously for electrode with a preferential diffusion along the axis (FIG. 12), a maximum cell voltage reduction of about 0.35 V at 0.03 A $cm^{-2}$ was obtained and it was observed that this reduction tends to disappear for a current density higher than 0.2 A $cm^{-2}$. In the present case, a maximum voltage drop is obtained at 0.05 A $cm^{-2}$ with a difference of about 0.4V. Despite this represents only an improvement of 0.05V over the previous case, the principal effect lies in the fact that a significant cell voltage reduction can be obtained for higher current densities.

Figure 12:
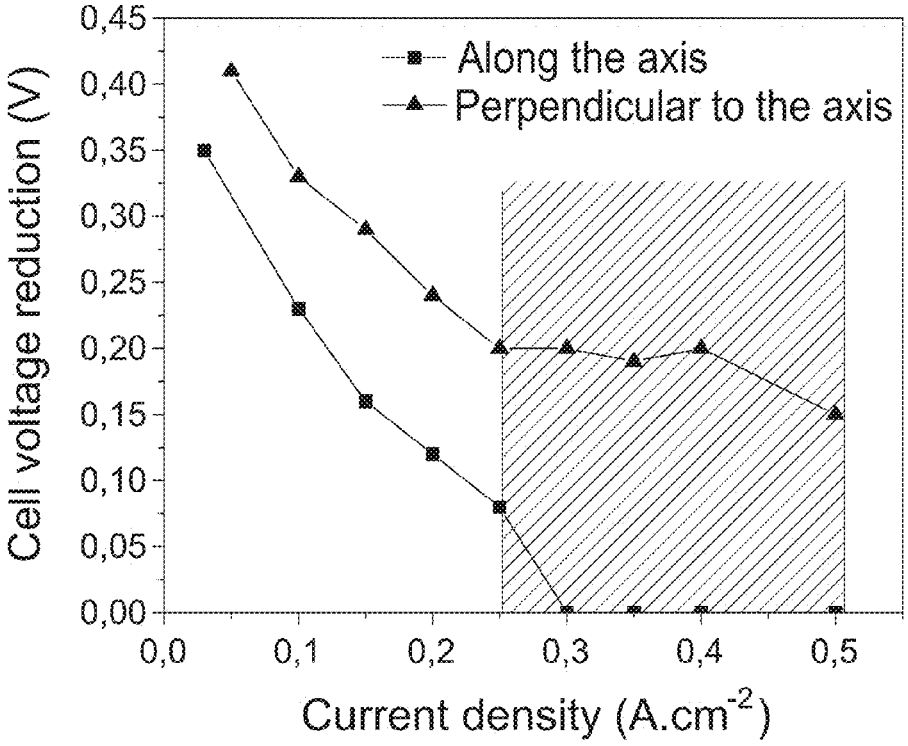
FIG. 12 is a graphical representation of the measured evolution of the maximum cell voltage reduction with the current density obtained for an electrode with preferential diffusion along the axis and perpendicular to the axis.
Figure 13:
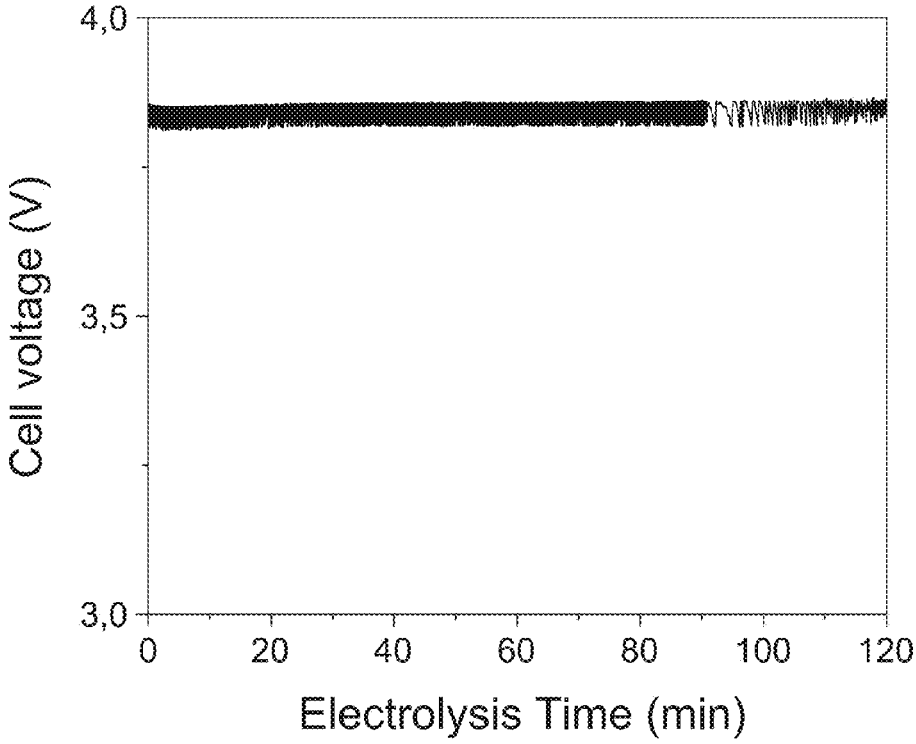
FIG. 13 is a graphical representation of the measured variation of the cell voltage during Mg electrolysis at 0.35 A $cm^{-2}$ and under a hydrogen flow rate of 18 $cm^3$ $min^{-1}$.

For a better understanding, the variation of the maximum drop of cell voltage is plotted in FIG. 12 for the two types of electrode. Despite the fact that in both cases the cell voltage reduction decreases with increasing the current density, it can be seen that for an optimized electrode the reduction reached a quite stable value at about 0.2V between 0.25 and 0.5 $A \cdot cm^{-2}$. Obtaining a cell voltage reduction in this region represents an important result because industrial electrolytic cells usually operate in this range of current density. This result indicates that the distribution of the $H_2$ bubbles has a strong influence on the efficiency of the process. Thus, it has been demonstrated that by simply decreasing the size and increasing the density of the $H_2$ bubbles at the anode surface, it is possible to improve the efficiency of the reaction. Finally, to test the stability of the hydrogen anode, chronopotentiometric measurement was conducted for 2 h at an anodic current density of 0.35 A $cm^{-2}$ under a $H_2$ flow rate of 18 $cm^3$ $min^{-1}$. The variation of the cell voltage is shown in FIG. 13. It can be observed that magnesium electrolysis with hydrogen anodes operates very well with a stable behaviour. The small variations observed on the electrolysis curve are due to the bubbles and have an amplitude of only 0.05V.

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

While the invention has been described in connection with specific embodiments thereof, it will be understood that it is capable of further modifications and this application is intended to cover any variations, uses, or adaptations of the invention and including such departures from the present disclosure as come within known or customary practice within the art to which the invention pertains and as may be applied to the essential features hereinbefore set forth, and as follows in the scope of the appended claims.

What is claimed is:

1. An anode arrangement for use in an electrolysis production of metals comprising:

an electrolytic bath;

an anode vertically disposed in the electrolytic bath, the anode having a hollow body comprising a cavity extending longitudinally from a top end portion to a bottom end portion, said hollow body having a plurality of gas outlets connected in fluid flow communication with the cavity, wherein the plurality of gas outlets are symmetrically spaced around the hollow body of said anode and the size of said plurality of gas outlets increases from the top end portion of the anode to the bottom end portion of the anode proportionally with an increase in hydrostatic pressure exerted by the electrolytic bath along the hollow body of the anode;

a gas inlet connected in fluid flow communication with the cavity of said anode, said gas inlet being connectable to a source of hydrogen gas for feeding hydrogen gas into the cavity of said anode;

an electrical connector for generating a current at the anode during electrolysis; and a hydrogen chloride (HCl) recuperator surrounding at least a portion of the anode for recovering HCl gas released through the plurality of gas outlets at an outer surface of the anode during electrolysis, said HCl recuperator having an outlet connectable to a HCl redistributor.

2. The anode arrangement of claim 1, wherein the gas inlet is connected to said top portion or bottom portion of the anode.

3. The anode arrangement of claim 1, wherein the electrical connector extends into the cavity of said anode.

4. The anode arrangement of claim 3, wherein said electrical connector extends into the gas inlet into the cavity of said anode.

5. The anode arrangement of claim 1, wherein said metals are magnesium or aluminum.

6. The anode arrangement of claim 1, wherein said anode is a cylindrical anode.

7. The anode arrangement of claim 1, wherein the plurality of gas outlets are spaced in rows and columns on the body of said anode.

8. The anode arrangement of claim 7, wherein the plurality of gas outlets within each row are of the same size.

9. The anode arrangement of claim 1, wherein the plurality of gas outlets are cylindrical bores.

10. The anode arrangement of claim 1, wherein the plurality of gas outlets are elongated channels tapering from the bottom end portion to the top end portion of the anode.

11. The anode arrangement of claim 1, wherein said anode is a metal diffuser.

12. The anode arrangement of claim 1, wherein said anode is made of sintered metal powders.

13. The anode arrangement of claim 1, wherein said anode is made of graphite or Hastalloy X.

14. The anode arrangement of claim 1, wherein the gas inlet is the HCl recuperator, extending partially and surrounding at least a portion of the anode recovering HCl gas released through the plurality of gas outlets at the outer surface of the anode during electrolysis.

15. The anode arrangement of claim 1, wherein the HCl recuperator is a sintered alumina tube.

16. The anode arrangement of claim 1, wherein the at least one gas outlet has an opening of at least 5 μm.

17. The anode arrangement of claim 1, further comprising an electrocatalyst in the anode.

18. An electrolytic cell for electrolyzing metals chloride comprising, the anode arrangement of claim 1;

a cathode being separated from the anode, the HCl gas released through the gas outlet at the outer surface of the anode is separated from the metals produced at the cathode;

and an electrolytic chamber containing the electrolytic bath, said cathode and said anode.

* * * * *